US010221505B1

(12) United States Patent
Sentongo

(10) Patent No.: US 10,221,505 B1
(45) Date of Patent: Mar. 5, 2019

(54) TEXTILE PRODUCTS INCORPORATING BANANA OR RAFFIA FIBER AND METHODS OF FABRICATING THE SAME

(71) Applicant: Julius Sentongo, Washington, DC (US)

(72) Inventor: Julius Sentongo, Washington, DC (US)

( * ) Notice: Subject to any disclaimer, the term of this patent is extended or adjusted under 35 U.S.C. 154(b) by 201 days.

(21) Appl. No.: 15/149,770

(22) Filed: May 9, 2016

Related U.S. Application Data

(60) Provisional application No. 62/158,325, filed on May 7, 2015.

(51) Int. Cl.
*D03D 15/00* (2006.01)

(52) U.S. Cl.
CPC ..... *D03D 15/00* (2013.01); *D10B 2201/01* (2013.01); *D10B 2201/02* (2013.01); *D10B 2211/04* (2013.01); *D10B 2331/04* (2013.01)

(58) Field of Classification Search
CPC ..... D03D 15/00; D10B 2201/01; D10B 2201/02; D10B 2331/04; D10B 2211/04
See application file for complete search history.

(56) References Cited

U.S. PATENT DOCUMENTS 7,654,116 B1 * 2/2010 Trelease ..... D04B 1/24 66/176
2008/0034562 A1 * 2/2008 Wensley ..... A61G 17/00 27/3

FOREIGN PATENT DOCUMENTS

CN 102776655 * 11/2012
GB 185863 * 9/1922
GB 301627 * 12/1928

* cited by examiner

*Primary Examiner* — Cephia D Toomer
(74) *Attorney, Agent, or Firm* — Dunlap Bennett & Ludwig PLLC

(57) ABSTRACT

A textile product embodying a method of fabrication using banana and/or raffia fiber as the weft is provided. The banana and/or raffia fibers provide a softness and capability of being threaded for facilitating interweaving about the warp, while also providing the tensile strength yet flexibility to weave durable textile products on a handloom, all while being non-toxic for the environment.

8 Claims, 1 Drawing Sheet

TEXTILE PRODUCTS INCORPORATING BANANA OR RAFFIA FIBER AND METHODS OF FABRICATING THE SAME

CROSS-REFERENCE TO RELATED APPLICATION

This application claims the benefit of priority of U.S. provisional application No. 62/158,325, filed 7 May 2015, the contents of which are herein incorporated by reference.

BACKGROUND OF THE INVENTION

The present invention relates to methods of weaving and, more particularly, to a method of fabricating textile products using banana and/or raffia fiber as the weft.

Weaving is a method of textile production in which two distinct sets of thread are interlaced at right angles to form a fabric or cloth. The longitudinal threads are called the warp and the lateral threads are the weft. Cloth is usually woven on a loom, a device that holds the warp threads in place while weft threads are woven through them. The method in which these threads are inter woven affects the characteristics of the resulting textile product. So does the material used for either the weft or the warp.

Today plastics are used as the weft. Plastic products, unfortunately, are a problem for the environment, and are manufactured with machines that can be dangerous.

As can be seen, there is a need for a novel textile product embodying a method of fabrication using banana and/or raffia fiber as the weft.

SUMMARY OF THE INVENTION

In one aspect of the present invention, a textile product includes either banana or raffia fibers as a weft.

In another aspect of the present invention, method of manufacturing a textile product, comprising the step of interweaving with a weft comprising either banana or raffia fiber.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a textile product embodying a method of fabrication using banana and/or raffia fiber as the weft. The banana and/or raffia fibers provide a softness and capability of being threaded for facilitating interweaving about the warp, while also providing the tensile strength yet flexibility to weave durable textile products on a handloom, all while being non-toxic for the environment.

Figure 1:
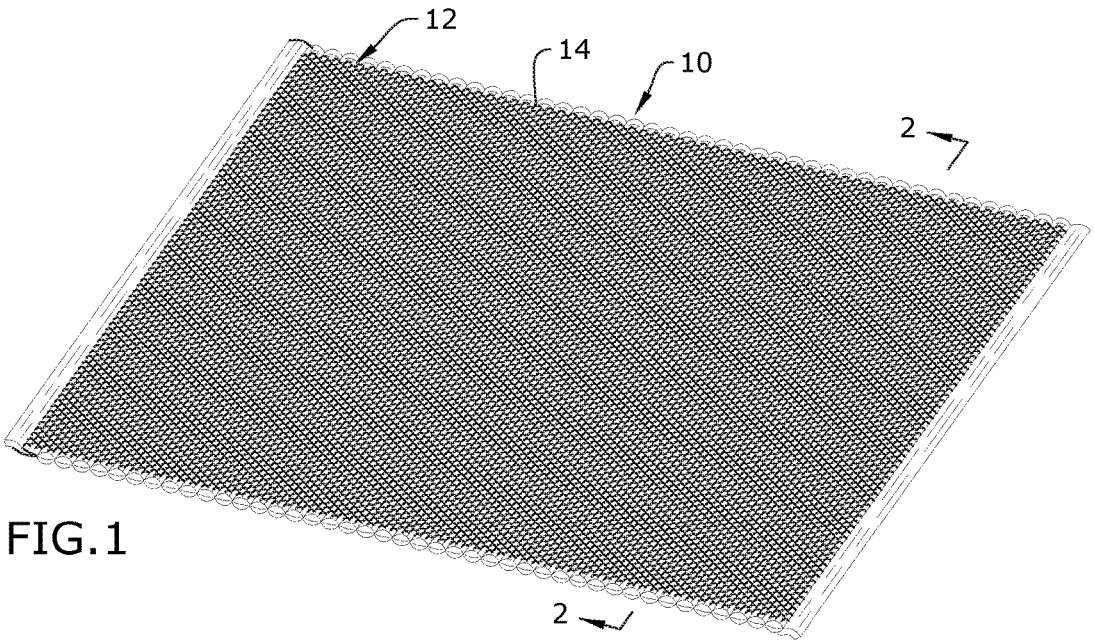
FIG. 1 is a perspective view of an exemplary embodiment of the present invention.
Figure 2:
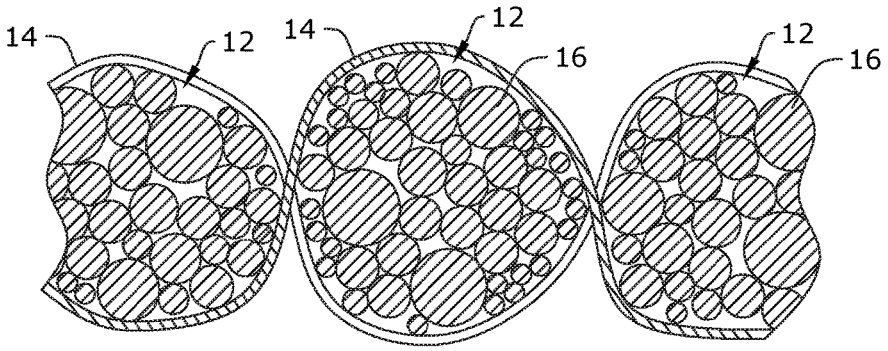
FIG. 2 is a section view of an exemplary embodiment of the present invention, taken along line 2-2 in FIG. 1.

Referring to FIGS. 1 and 2, the present invention may include a textile product 10 embodying a method of fabrication using banana fiber or raffia fiber 16 as the weft 12. The textile product 10 incorporates banana and/or raffia fiber 16 woven as the weft 12 in cotton, silk or the like warp 14, as illustrated in FIGS. 1 and 2. The textile product 10 can be woven using a handloom or a power loom. The banana and/or raffia fibers 16 may be dyed before or after weaving.

The banana and/or raffia fiber 16 provides sufficient textile strength so that the textile product 10 may take the form of placemats, runners, window blinds, wall hangings, floor mats, roofing material and the like.

The banana and/or raffia fiber 16 provides serval advantages over plastics, while having the benefit of by natural component, and non-toxic to the environment. First, when treated, the banana and/or raffia fibers 16 provide a softness enabling the banana and/or raffia fiber 16 to fold and be interwoven about the warp as the weft during the weaving process. The banana and/or raffia fiber 16, unlike plastics, may be threaded into small strings that can be used on the loom as weft. The banana and/or raffia fiber 16 also provide the tensile strength needed while the weft is held under high tension by the loom during the entire process of weaving. Furthermore, the banana and/or raffia fibers 16 are flexible, facilitating weaving on a handloom; something plastic wefts would make impractical.

The use of banana and/or raffia fiber 16 interwoven in cotton, silk or polyester warp in a power loom also makes both the warp and the weft look interchangeable. Furthermore, the colorfulness of the banana and/or raffia fiber 16 can be enhanced through dying so as to provide colored thread warp. Moreover, the banana fiber material and Raffia can be woven in threads with a zig zag locking (fringe), wherein the gap better the thread (warp) is larger than that of thread used to weave raffia, and/or wherein the gap better the thread (warp) is larger than that of thread used to weave raffia two threads interlocking with each other. Alternatively, the banana fiber material only may be used, woven in color threads with a zigzag locking (fringe), wherein the gap better the thread (warp) is larger than that of thread used to weave raffia Two threads interlock with each other.

In another embodiment, plain Raffia material with two stripe dyed raffia design with a folding at the end (not a zigzag), wherein the gap between the threads is narrower than that of thread used to weave banana fiber, and wherein a single thread interlock each other.

In certain embodiments, dyed raffia material woven in color thread with a fold at the end (not a zigzag), wherein the gap between the threads is narrower than that of thread used to weave banana fiber, and wherein a single thread interlock each other.

What that means is a user may make different colors of the raffia material with different thread color. The length or width of the placemats and runners is changeable, for this reason these woven raffia or banana fiber can be used for other purposes if the length or width size is altered; for example, for blinds or carpeting.

It should be understood, of course, that the foregoing relates to exemplary embodiments of the invention and that modifications may be made without departing from the spirit and scope of the invention as set forth in the following claims.

What is claimed is:

1. A textile product comprising a plurality of warps interwoven with a plurality of wefts; each weft comprising two or more threads that are interlocked; the two or more threads comprising at least one banana fiber string and at least one raffia fiber string.

2. The textile product of claim 1, further comprising either cotton, polyester, or silk as the plurality of warps.

3. The textile product of claim 1, wherein the textile produce is a mat.

4. A method of manufacturing a textile product, comprising the step of interweaving the plurality of wefts of claim 1 with the plurality of warps of claim 1.

5. The method of claim 4, wherein said plurality of warps comprise either cotton, polyester, or silk.

6. The method of claim 4, further comprising the step of providing a handloom for manufacturing the textile product.

7. The textile product of claim 1, wherein the two or more threads are interlocked with zig zag locking.

8. A textile product comprising a plurality of warps interwoven with a plurality of wefts; each weft comprising at least one banana fiber string and at least one raffia fiber string.

* * * * *